US005332174A

United States Patent [19]

Cook

[11] Patent Number: 5,332,174

[45] Date of Patent: Jul. 26, 1994

[54] REUSABLE RIBBON CASSETTE

[75] Inventor: John C. Cook, Transvaal, South Africa

[73] Assignee: Telkor (Proprietary) Limited, South Africa

[21] Appl. No.: 993,710

[22] Filed: Dec. 21, 1992

[30] Foreign Application Priority Data

Dec. 19, 1991 [ZA] South Africa ..... 91/9989

[51] Int. Cl.[5] ..... B41J 35/28

[52] U.S. Cl. ..... 242/348; 400/208; 400/242

[58] Field of Search ..... 242/197, 198, 199; 400/208, 242, 243

[56] References Cited

U.S. PATENT DOCUMENTS

| | | | |
|---|---|---|---|
| 3,653,608 | 4/1972 | Dickens et al. | 242/199 |
| 4,019,695 | 4/1977 | Wharam | 242/199 |
| 4,264,223 | 4/1981 | Bemis et al. | 242/199 X |
| 4,359,288 | 11/1982 | Bullock | 242/197 X |
| 5,073,052 | 12/1991 | Daley et al. | 400/208 |

FOREIGN PATENT DOCUMENTS

| | | | |
|---|---|---|---|
| 2722132 | 12/1977 | Fed. Rep. of Germany | 242/199 |

*Primary Examiner*—Daniel P. Stodola
*Assistant Examiner*—John P. Darling
*Attorney, Agent, or Firm*—Finnegan, Henderson, Farabow, Garrett & Dunner

[57] ABSTRACT

A cassette casing adapted to house a replaceable ribbon including spaced spool carrier shafts rotatably mountable within the casing, at least one of the shafts being retractable from the casing in an axial direction and a device to lock the shaft against retraction. The casing also includes a device providing a guide path for the ribbon to travel from one spool to another, and a loading aperture in the casing through which at least one removable spool may be inserted into the cassette in a direction transverse to the axis thereof to be suitably positioned for insertion of the retractable spool carrier shaft into or retraction of the shaft from the bore of the spool.

8 Claims, 2 Drawing Sheets

REUSABLE RIBBON CASSETTE

FIELD OF INVENTION

THIS invention relates to print ribbons. More particularly the invention is concerned with print ribbon cassettes, especially for use in ticket issuing devices.

BACKGROUND TO INVENTION

It is well known to provide ribbon or tape carrying cassettes for apparatus such as ticket issuing devices, typewriters, computer printers, video recorders and the like. In most cases the cassette is used until the print ribbon is expended whereafter the cassette as a whole is simply discarded. The useful life of a ribbon normally comprises no more than two passes of the ribbon from spool to spool, achieved by inverting the cassette after the first pass has been completed, so that the discarding of the cassette casing, a not inexpensive construction, represents a substantial wastage.

OBJECT OF INVENTION

It is an object of the invention to provide a cassette which is designed for easy replacement of an expended ribbon, such as a print ribbon so that the casing itself can be re-used. Reference herein to "ribbon" includes, tape, magnetic tape and the like.

SUMMARY OF THE INVENTION

According to the invention a cassette casing adapted to house a replaceable ribbon includes spaced spool carrier shafts rotatably mountable within the casing, at least one of the shafts being retractable from the casing in an axial direction, means to lock the shaft against retraction, means providing a guide path for a ribbon to travel from one spool to another, and a loading aperture in the casing through which at least one removable spool may be inserted into the cassette in a direction transverse the axis thereof to be suitably positioned for insertion of the retractable spool carrier shaft into or retraction of the shaft from the bore of the spool.

Also according to the invention the cassette casing comprises sides supported in suitably spaced relationship by post members and a spool-loading aperture provided in an edge zone of the casing.

Preferably the loading aperture is provided by a removable edge wall section, the remainder of the edge having a fixed wall.

Preferably also the cassette casing includes a body section, within which the spool carrier shafts are located, and spaced pincer-like extension sections, the pincer-like extension sections providing the guide path for a ribbon extending from a feed spool to a drive spool on the carrier shafts.

It will be appreciated that by rendering the retractable spool carrier shaft axially removable, and providing for edge-wise loading of a ribbon spool into the casing, removal of a side of the casing for loading or unloading of the cassette is rendered unnecessary. The replacement of a ribbon is thus made extremely simple.

Further according to the invention each spool carrier shaft is journaled in suitable vertically opposed pairs of holes provided in the sides of the casing, one such hole of a pair being smaller than the other and the spool carrier shaft having a peripheral shoulder towards one end thereof, the shoulder zone of the shaft fitting neatly in the smaller hole while the other end of the shaft fits neatly in the larger hole.

With this arrangement a shaft is easily mounted for rotation in the casing by inserting the shaft, shoulder end first, into the larger hole and pressing the shaft home until shoulder engages in the smaller hole and the shaft is arrested. If a ribbon-carrying spool is first located in register with the holes so that the shaft enters the bore of the spool, the latter is thus mounted on the spool carrier shaft.

Preferably the shaft incorporates a key formation or the like to engage a mating formation on the spool so that the latter will rotate with the shaft on the drive side.

In a working embodiment of the cassette of the invention the spool carrier shafts are tubular members which have internal spline means to engage the teeth of a drive gear in a printer. Thus either one of the spool carrier shafts may be driven, together with the spool mounted thereon, for feeding of the ribbon from a ribbon carrier spool to a drive or take-up spool in the printing process.

Releasable locking means may also be provided for trapping the spool carrier shaft in the cassette casing. For example, a locking tongue may be located adjacent each larger hole of the two pairs of holes, the tongue being slidable back and forth over the end of a spool carrier shaft between a first position in which the shaft is locked within the cassette casing and a second position in which the shaft is free to be withdrawn from the casing via the larger of the two holes in which it is journaled.

Still further according to the invention the hole pairs are reversed in the casing so that each side of the casing has one large and one small spool carrier shaft receiving hole of the two pairs, whereby the shafts are inserted into the casing one on the one side and the other on the other side thereof.

BRIEF DESCRIPTION OF THE DRAWINGS

In order to illustrate the invention an example is described below with reference to the accompanying drawings in which.

DETAILED DESCRIPTION OF THE INVENTION

Figure 1:
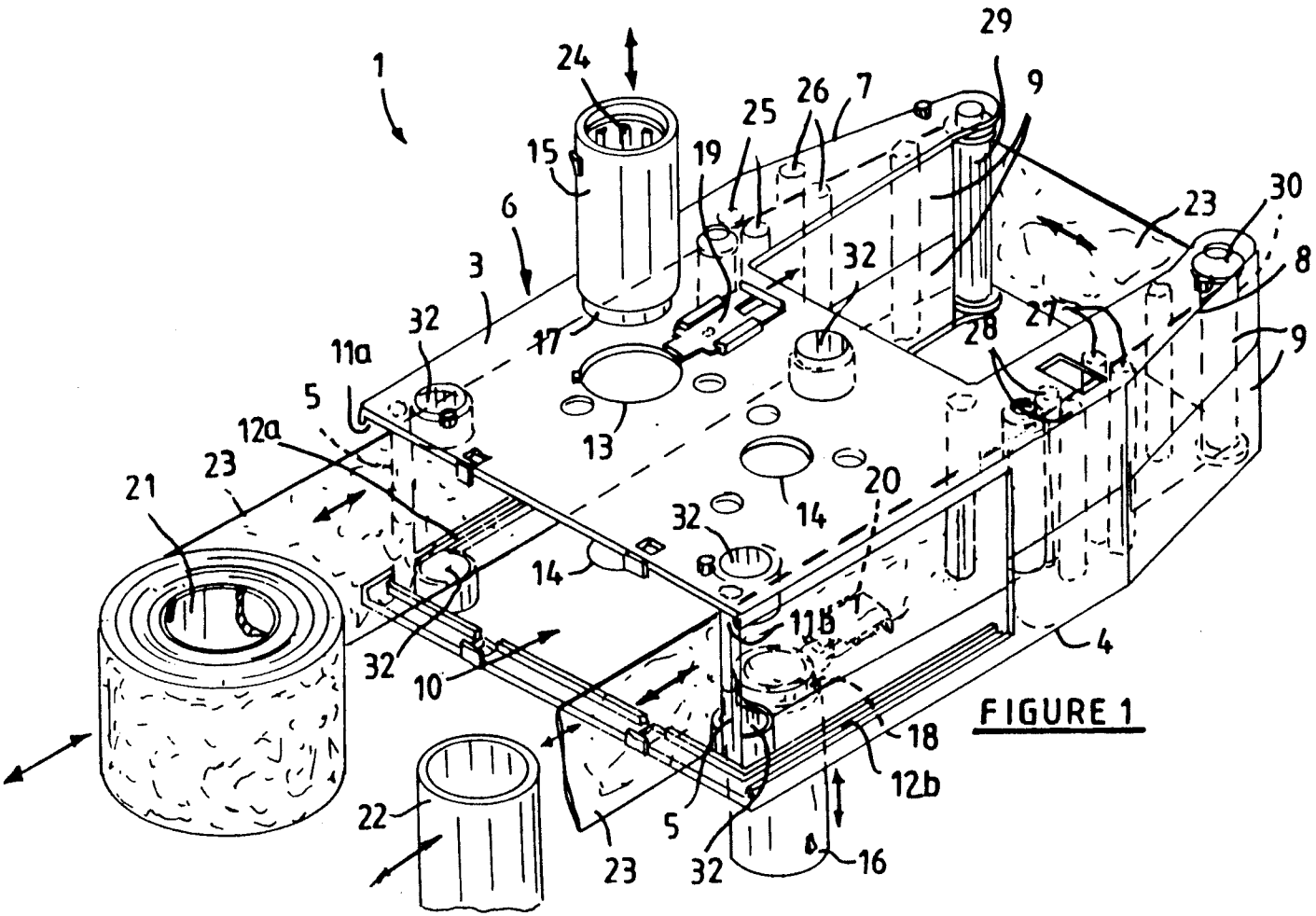
FIG. 1 is an exploded perspective view of a print ribbon cassette according to the invention.

Referring to the drawings, the print ribbon cassette 1 is designed for use in the print head assembly (not shown) of a ticket issuing device incorporating a bed plate 2.

The cassette comprises upper and lower sides 3 and 4 which except as described hereunder, are mirror images of one another.

Figure 2:
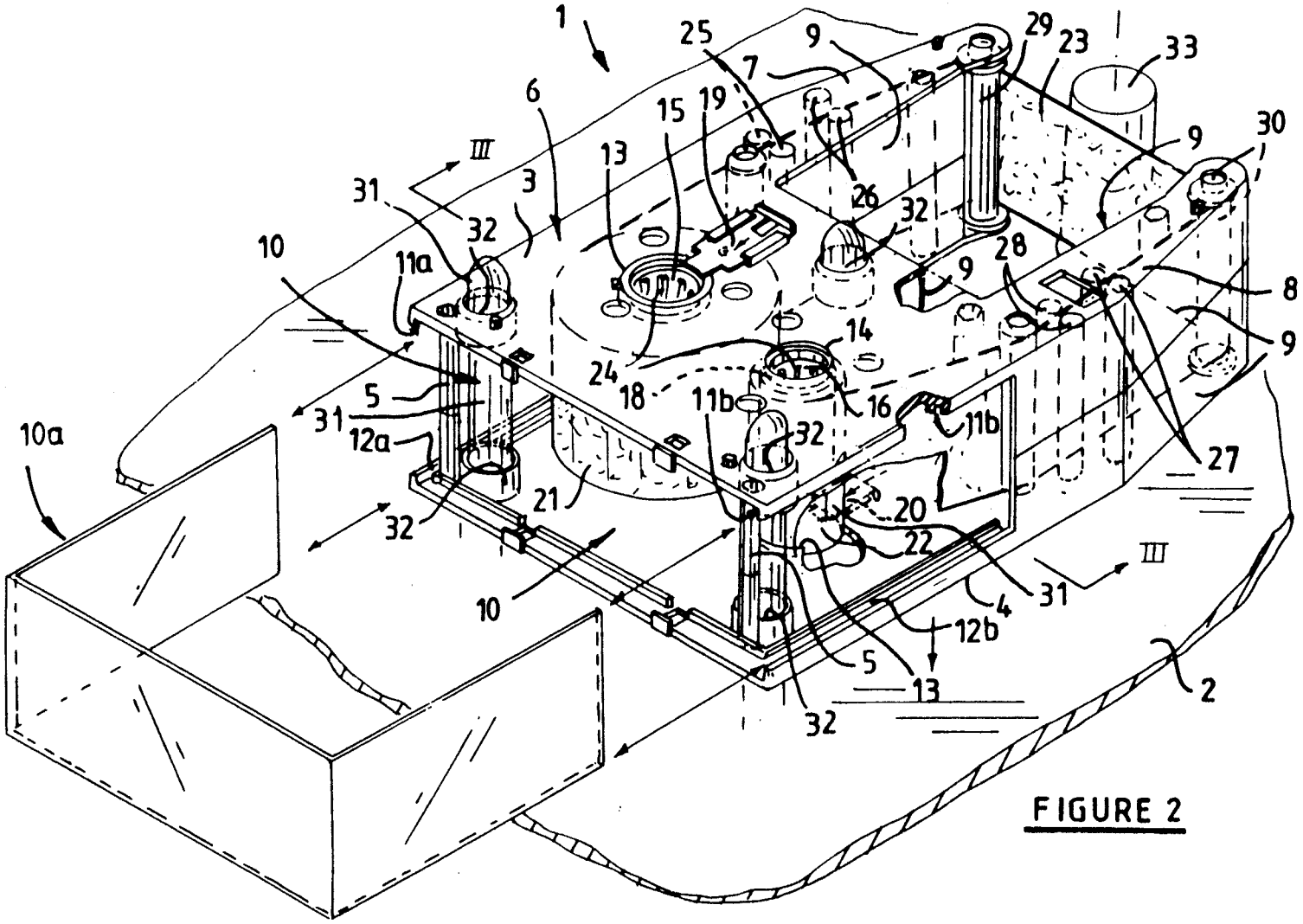
FIG. 2 is an alternative exploded perspective view of the cassette of FIG. 1 with parts broken away and showing the cassette mounted on the bed plate of a ticket issuing device.

The sides 3 and 4 are supported in spaced relationship on posts 5 to provide a casing having a body section 6 and spaced pincer-like extension sections 7 and 8. The edge of the casing is closed in the pincer sections by fixed walls 9 while the edge zone of the body section of the casing is open and provides a loading aperture 10 which may be closed by a removable U-shaped edge wall section 10*a* which (see FIG. 2) can slide into and out of channels 11*a* and 11*b* and 12*a* and 12*b* on the sides 3 and 4 respectively of the cassette casing.

The sides 3 and 4 are provided with pairs of holes 13 and 14, the holes 13 being larger than the holes 14 and the hole pairs being reversed in the casing so that each side has one larger hole 13 and one small hole 14 and vertically opposed pairs of holes in the spaced sides also include one large hole 13 and one small hole 14.

Tubular spool carrier shaft members 15 and 16 may be mounted in the casing, each in its own pair of holes 13 and 14, by insertion into the large hole 13 and pressing home until a shoulder 17 on the shaft 15 and a shoulder 18 on the shaft 16 engage respectively in the small holes 14. The diameter of the shoulders 17 and 18 is such as to engage neatly in the holes 14 while the larger diameter of the shaft members is a close-fit in the holes 13 so that the shafts 15 and 16 are trapped in the holes 13 and 14 and are journaled for rotation therein. Locking tongues 19 and 20 are provided, one on each side 3 and 4 of the casing respectively, the tongues being located one adjacent each large hole 13 of the two pairs of holes for sliding movement back and forth over the end of a spool carrier shaft between a first position in which the shaft is locked within the cassette casing and a second position in which the shaft is free to be withdrawn from the casing via large hole 13.

Spools 21 and 22 for a print ribbon 23 may be mounted for rotation within the body section 6 of the cassette casing by removing the edge wall section 10*a* and inserting the spools through the loading aperture 10 so that each spool is located in axial register with a pair of holes 13 and 14. The spool carrier shafts 15 and 16 are then inserted one into each pair of holes so as to pass one each through the bore of the relevant spool.

The tongues 19 and 20 are then slid to a position illustrated in FIG. 1 so as to lock the shafts in the casing in their respective spools. Each shaft 15 and 16 has internal splines 24 which may engage a drive gear (not shown) of the printer assembly. Thus in FIG. 1 the drive gear would engage the splines of shaft 16 thereby rotating it and the spool 22 thereon to draw the ribbon from fully loaded feed spool 21 onto the drive or take-up spool 22 as the printing process proceeds.

In loading the cassette with a print ribbon the full fresh spool 21 is first mounted in the cassette as described above. The ribbon 23 is then fed along a guide path extending between guide roller pairs 25, 26 in the pincer section 7, around end guide rollers 29 and 30 and between guide roller pairs 27, 28 in the pincer section 8.

The end of the ribbon is then attached to the empty spool 22 which previously constituted the feed spool and which is already mounted on its spool carrier shaft 16. The removable wall section 10*a* may then be replaced on the cassette casing by sliding it into the channels 11*a* and 12*a* and 11*b* and 12*b* whereafter the print ribbon cassette can be mounted in the printer assembly by engaging locating pins 31, provided on the bed plate of the printer assembly, in bosses 32 provided in the sides 3 and 4 of the cassette casing. With the cassette thus mounted on the locating pins 31 a print head (not shown) is accommodated between the pincer sections 7 and 8 and behind the ribbon 23 extending between such pincers so that printing may be effected on a ticket (not shown) drawn between the ribbon 23 and the platen 33.

It will be appreciated that the spools 21 and 22 should rotate freely within the cassette and for this reason must conform to a standard size. In order to achieve a standard production size the spools are preferably injection molding from suitable plastic material. Similarly the parts of the cassette casing are constructed by injection molding from a suitable plastic material, preferably a transparent material. When the print ribbon has been fed from the feed spool 21 onto the take-up spool, the cassette may be flipped for re-use of the ribbon and this process may be repeated a number of times until the ribbon is spent. Thereafter a fresh ribbon may replace the spent one as described above.

I claim:

1. A cassette casing adapted to receive a replaceable spool of ribbon, said spool having a bore, the casing comprising two spaced sides, two spaced spool carrier shafts rotatably mountable within the casing, each spool carrier shaft being journaled in opposed pairs of holes provided in the opposed sides of the casing, one hole of each pair being smaller than the other and each spool carrier shaft having an area of reduced diameter at one end terminating axially thereof in a peripheral shoulder, said one end of each shaft being journaled in the smaller hole while the opposite end of the shaft is journaled in the larger hole, at least one of the spool carrier shafts being retractable from the casing through a larger hole in the axial direction thereof, means for locking the retractable shaft in the casing against retraction, means providing a guide path for the ribbon to travel in the casing from a spool on one spool carrier shaft to a spool on the other shaft, and a loading aperture in the casing through which said spool of ribbon may be inserted into the cassette between said two sides in a direction transverse to the axis of the spool and be positioned in the casing for insertion of said retractable spool carrier shaft through the bore of said spool of ribbon to hold the spool of ribbon within the casing for rotation.

2. The cassette casing of claim 1, wherein the opposed sides are supported in spaced relationship by post members mounted between the sides and the loading aperture for insertion of the spool of ribbon is located in an end of the casing between the opposed sides.

3. The cassette casing of claim 2, including a removable wall section covering the loading aperture at the end of the casing.

4. The cassette casing of claim 2, having a body section comprising the two spaced sides within which the spool carrier shafts are journaled and spaced extension arms extending outwardly from said body section at an end opposite from the end having the loading aperture, the extension arms providing the guide path for the ribbon extending from the spool of ribbon on said retractable shaft acting as a feed shaft to the spool on the other shaft acting as a drive shaft.

5. The cassette casing of claim 4, wherein the spool carrier shaft acting as the drive shaft includes a key formation adapted to engage a complimentary formation on the spool on said drive shaft so that said spool will rotate with the drive shaft when it is driven.

6. The cassette casing of claim 1, wherein the spool carrier shafts are tubular members having internal spline means adapted to engage with teeth of a drive gear of a printer.

7. The cassette casing of claim 1, wherein both carrier shafts are retractable from the casing through said larger holes, each provided with locking means for locking the shaft in the casing against retraction, the locking means comprising a locking tongue located adjacent each larger hole, the tongue being slidable back and forth over an end of the spool carrier shaft between a first position in which the shaft is locked within the cassette casing and a second position in which the shaft is free to be retracted from the casing.

8. The cassette casing of claim 1, wherein the pairs of holes are reversed in the casing so that each side of the casing has one large and one small spool carrier shaft receiving hole of the two pairs, whereby one spool carrier shaft is inserted into the casing from one side and the other spool carrier shaft from the other side of the casing.

* * * * *